US005595237A

United States Patent [19]

Fischer

[11] Patent Number: 5,595,237

[45] Date of Patent: Jan. 21, 1997

[54] HORIZONTAL CONTINUOUS CASTING APPARATUS FOR METALS

[75] Inventor: Eberhard Fischer, Bütthard, Germany

[73] Assignee: Mannesmann Aktiengesellschaft, Dusseldorf, Germany

[21] Appl. No.: 538,770

[22] Filed: Oct. 5, 1995

Related U.S. Application Data

[63] Continuation of Ser. No. 220,291, Mar. 30, 1994, abandoned.

[30] Foreign Application Priority Data

Mar. 30, 1993 [DE] Germany ..... 43 11 031.2

[51] Int. Cl.[6] ..... B22D 11/10

[52] U.S. Cl. ..... 164/440; 164/490

[58] Field of Search ..... 164/440, 490

[56] References Cited

U.S. PATENT DOCUMENTS 3,908,747 9/1975 Kuttner ..... 164/440

FOREIGN PATENT DOCUMENTS 0067433 2/1985 European Pat. Off. .
3330810 3/1985 Germany .
56-111552 9/1981 Japan ..... 164/440
61-199553 9/1986 Japan ..... 164/440

*Primary Examiner*—Kuang Y. Lin
*Attorney, Agent, or Firm*—Cohen, Pontani, Lieberman, Pavane

[57] ABSTRACT

The invention is directed to a device for the horizontal continuous casting of metals having a holding furnace with a horizontally extending outlet conduit arranged in a side wall of the holding furnace, a graphite mold associated with the outlet conduit, and a cooling structure which encloses the mold and is flanged to a casing of the holding furnace. In order to provide a uniform flow of metal in the inlet region of the mold, a flow restricting structure is arranged inside the outlet conduit of the holding furnace. The restricting member is made of refractory material and defined with an interior surface of the outlet conduit a melt passage. The restricting structure is dimensioned such that the cross-sectional profile or area of the melt passage is smaller than the cross-sectional surface of the mold cavity.

4 Claims, 1 Drawing Sheet

HORIZONTAL CONTINUOUS CASTING APPARATUS FOR METALS

This is a continuation, of application Ser. No. 08/220,291, Mar. 30, 1994 and now abandoned.

BACKGROUND OF THE INVENTION

1. Field of the Invention

This invention relates generally to the casting of metals, and more particularly, to a horizontal continuous casting apparatus.

2. Description of the Prior Art

Continuous, horizontal casting of metals such as copper and its alloys typically requires a device which includes a casting trough and a holding furnace or the like having in one wall near the bottom a tapping hole which connects up to a nozzle through which the molten metal is transferred to the mold. For an example of one such system, reference may be had to published German Patent Specification DE-PS 26 57 207.

As will be readily appreciated by those skilled in the art, the components used for the melt transfer system in horizontal casting are generally made of refractory materials in some versions in combination with nozzles made of graphite or another suitable material, or of insulated or plasma coated metal. The outlet for the melt is situated near the floor of the holding furnace or casting trough and connects up with the opening in the lower part of the nozzle.

In U.S. Pat. No. 3,593,778, it is suggested that surface defects in the quality of the billet (such as scabbing and cracking) be often caused by the manner in which the melt is fed from the supply vessel to the mold. When casting round billets, for example, it is known to connect to the outlet opening a channel-shaped part having a refractory lining and configured as a disc defining a circular opening. The metal leaves the trough via the nozzle on its way to the mold, the nozzle opening forming an abrupt transition, as a result of its position with respect to the inner face of the mold. Billets produced from such a system are frequently subjected to surface flaws, such as, for example, differences in the quality of the upper and lower surfaces of the billet, opened or concealed shuts, laps, bleeding, roughness, and surface segregation. Inside the billet there can be clusters of particles, internal cracks, and dross. It therefore becomes difficult to guarantee uniform quality.

The arrangement of plates provided with openings for the passage of the melt directly prior to entering the mold should have a positive effect on billet quality. However, such an arrangement also leads to defects because billet shell formations are already effected on the mold side of the plates.

Defects similar to those noted above are also encountered when molds are fed from a pipe or nozzle having a diameter smaller than the cross section of the mold. However, if the cross section of the melt through-opening is identical to or greater than the cross section of the mold, the solidification of the billet (casting shell formation) is negatively influenced by the flow of metal brought about by the induction currents, particularly in supply vessels designed as inductively heated holding furnaces.

It is therefore an object of the present invention to provide a device which avoids these disadvantages and which ensures a uniform flow of metal, especially copper and its alloys, in the inlet region of the mold.

SUMMARY OF THE INVENTION

The foregoing and additional objects, which will hereinafter become apparent to those skilled in the art, are achieved in accordance with the present invention by an apparatus for the horizontal continuous casting of metals, in particular copper and copper compounds.

The apparatus of the present invention comprises an inductively heated holding furnace with a horizontally extending outlet conduit arranged in a side wall of the holding furnace. Preferably, the outlet conduit is defined in the end wall of the holding surface. A graphite mold is disposed proximate the outlet conduit, and a cooling assembly encloses the mold. A suitable flange is provided for coupling the cooling assembly to the casing of the holding furnace. A flow restricting structure is arranged inside the outlet conduit of the holding furnace. The flow restricting structure is comprised of refractory material and is dimensioned and arranged within the conduit outlet to define a melt passage therewithin.

In accordance with an illustrative embodiment of the present invention, the flow restricting structure is a plate member having a peripheral edge surface portion secured to an interior wall surface portion of the outlet conduit. The plate member is preferably arranged at a distance from the mold inlet opening which is at least equal to the smallest cross sectional dimension of the mold cavity, and the melt passage is preferably defined between a second peripheral edge portion of the plate member and a second interior wall surface portion of the outlet conduit.

In accordance with an important aspect of the present invention, the diaphragm structure is dimensioned such that the cross-sectional profile or area of the melt through-opening is smaller than the cross-sectional profile or area of the mold. In fact, the cross-sectional area of the melt through-opening is preferably 50% or less than that of the mold, with a range of 20 to 50% of the cross-sectional surface of the mold being especially preferred.

In accordance with another aspect of the invention, the diaphragm structure is arranged at a distance from the mold which is equal to or greater than the smallest longitudinal dimension of the cross sectional profile of the mold. Additionally, the melt passage is preferably arranged in the lower half of the outlet conduit.

The various features of novelty which characterize the invention are pointed out with particularity in the claims annexed to and forming a part of the disclosure. For a better understanding of the invention, its operating advantages, and specific object attained by its use, reference should be had to the drawing and descriptive matter in which there are illustrated and described preferred embodiments of the invention.

BRIEF DESCRIPTION OF THE DRAWING

While the specification concludes with claims particularly pointing out and distinctly claiming the subject matter which is regarded as the invention, it is believed that the invention and the objects thereof will be better understood from the following description taken in connection with the accompanying drawing, in which:

The FIGURE is a view in longitudinal cross section depicting a horizontal continuous casting apparatus constructed in accordance with the present invention.

DETAILED DESCRIPTION OF THE PREFERRED EMBODIMENTS

Figure 1:
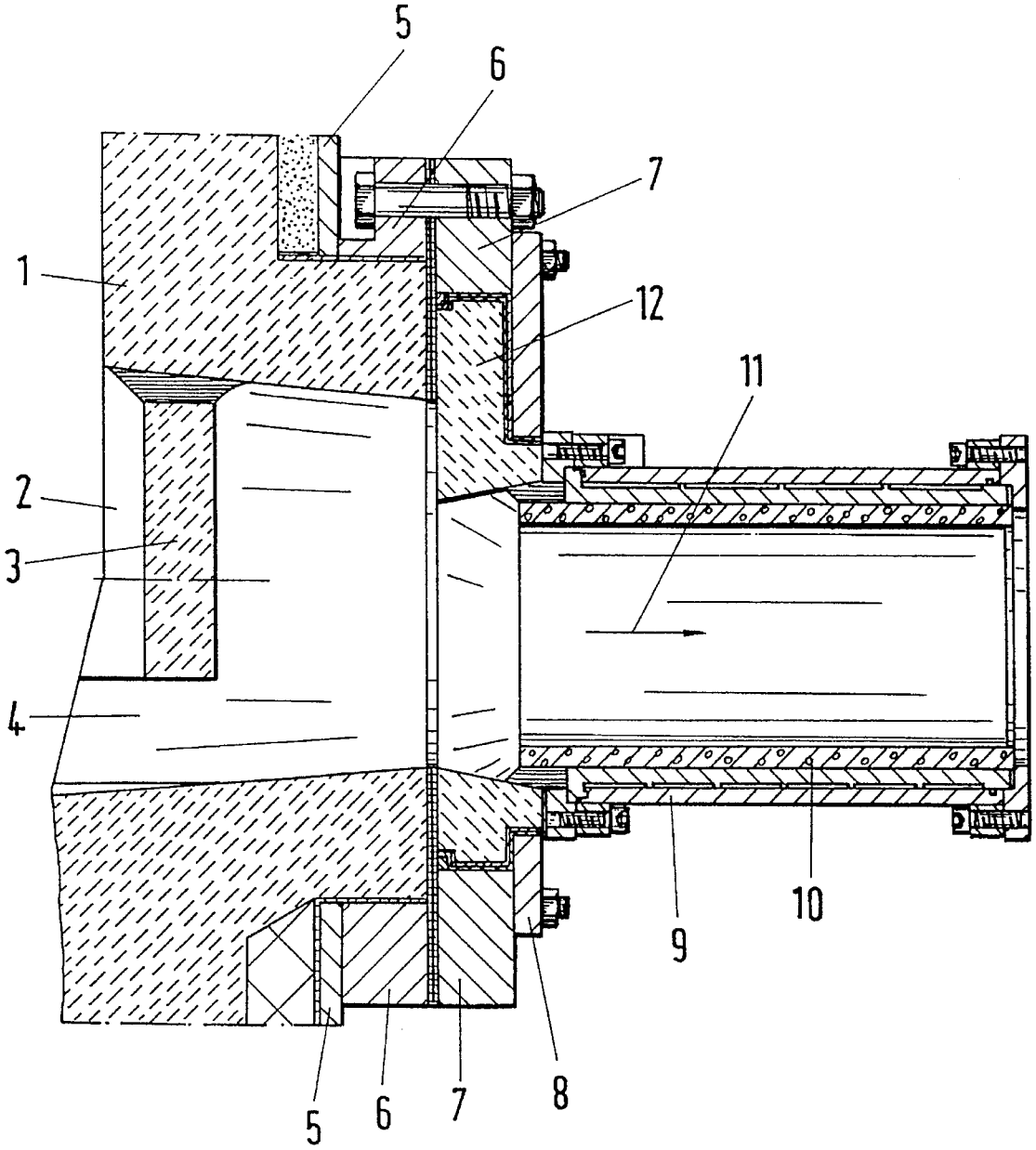

With reference to the FIGURE, there is illustrated an inductively heated furnace 1 which includes a vessel for containing liquid metal and is enclosed by an oven shell or casing 5. To permit the discharge of liquid metal from the vessel into the cavity of mold 10, a horizontally extending nozzle or conduit 2 aligned with the inlet opening of the mold cavity is defined in the end wall of furnace 1. In the illustrative embodiment, the mold 10 is a liquid cooled configuration which includes a cooling jacket or housing 9. Molds constructed in this manner are well known and provide cooling of the mold by recirculating a fluid such as water within a plurality of interior channels. The mold itself is preferably constructed of graphite, although any other materials possessing the desired mechanical and thermal properties may, of course, be substituted therefor.

As will be readily appreciated by those skilled in the art, the mold 10 may be secured to the furnace 1 utilizing any suitable structure. However, to achieve an even transfer of heat from mold 10, the illustrative embodiment of the present invention utilizes a transition structure comprising a front plate 6, a heat transfer frame 7, a flange 8, and an annular member 12 comprised of refractory material. As seen in the FIGURE, front plate 6 is a substantially annular member defining a central opening dimensioned and arranged to engage or otherwise receive an exterior portion of the furnace vessel which defines the discharge region of outlet conduit 14. Bolted to front plate 6 is heat transfer member 7, which is an annular plate member preferably formed from a metal or metal alloy adapted to transfer heat quickly. In a conventional manner, cooler housing 9 of mold 10 is secured by bolts to heat exchange frame 7. As will be readily ascertained by those skilled in the art, the heat exchange frame 7 is sealed and protected relative to furnace 1 and flange 8 by refractory member 12.

With continued reference to the FIGURE, it will be observed that a flow restricting means 3, which is configured as a restricting plate member in the illustrative embodiment, is disposed within outlet conduit 2. The restricting plate member is made of a refractory material and is dimensioned and arranged to define a melt passage 4 having a significantly reduced cross sectional area or profile relative to the remainder of the outlet conduit 2. More particularly, the restricting plate member cooperates with an interior sidewall portion of the outlet conduit to define a melt passage which has a cross sectional profile or area that is smaller than the cross sectional profile or area of the mold cavity.

In accordance with a preferred embodiment of the present invention, the restricting plate member is dimensioned in such a way that the cross-sectional area of the melt passage 4 is smaller than that of the mold 10 by more than half. Especially preferred is a melt passage cross sectional area 4 which is between 20 to 50% of the cross-sectional surface of the mold cavity.

The restricting plate member 3 is arranged in such a way that the melt passage 4 lies in the lower half of the outlet conduit 2. It is important in this respect that the restricting member 3 is arranged at a distance from the inlet opening of mold 10 which is equal to or greater than the smallest cross sectional dimension of the mold cavity. For example, when using a mold having a cavity with a circular cross section, the distance of the surface of the restricting member 3 which faces mold 10 should correspond at least to the diameter of the mold cavity.

The configuration of the restricting plate member utilized by the illustrative embodiment of the present invention ensures that the melt flowing into the mold 10 from the supply vessel has an extensively laminar flow so as to influence the shell formation in a positive manner. Further, the restricting plate member 3 ensures that the influence of the metal flow proceeding from and brought about by the inductor does not extend to the region of the shell formation in the mold. A reflux from the mold into the holding furnace 1 can also be achieved so that a melt with substantially the same temperature profile enters the mold.

The present invention offers many advantages over prior art horizontal continuous casting devices. The exchange of heat between the solidifying metal in the mold and the metal in the casting furnace, which must be maintained at pouring temperature, is substantially reduced. At the same time, the flushing or rinsing effect of the inductor at the mold inlet is also reduced, as are the influences of the filling level in the casting furnace and of the flowing metal when refilling. In particular, large dimensions (extrusion billets) can be cast more rapidly. The average casting output increases even more noticeably, since the casting rate need be reduced only slightly, if at all, when refilling the melt from the smelting furnace or foundry ladle. This provides increased safety since the risk of breakout is drastically reduced. There is a reduction in the energy required for maintaining the temperature of the melt in the casting furnace. The restricting means make it possible to maintain virtually constant casting parameters. Accordingly, the quality of the continuously cast products is improved.

The invention is not limited by the embodiments described above which are presented as examples only but can be modified in various ways within the scope of protection defined by the appended patent claims.

What is claimed is:

1. A horizontal continuous casting apparatus for metals, comprising:

an inductively heated liquid metal supply vessel, said vessel including a side wall region defining a horizontally extending outlet conduit;

a horizontal continuous casting mold defining a mold cavity having an inlet opening aligned with said outlet conduit;

means for cooling the mold; and a flow restricting plate member comprised of a refractory material and having a peripheral edge surface portion secured to an interior wall surface portion of said outlet conduit at a distance from said mold inlet opening at least equal to a smallest linear dimension of a cross-sectional area of the mold cavity so as to define a melt passage in a lower half of said outlet conduit, the plate member having a cross-sectional profile smaller than a cross-sectional profile of the mold cavity and smaller than said outlet conduit so that the cross-sectional area of said melt passage is less than half the cross-sectional area of the mold cavity.

2. The apparatus according to claim 1, wherein the cross-sectional area of the melt passage is between 20 to 50% of the cross-sectional area of the mold cavity.

3. The apparatus according to claim 1, wherein the distance of said plate member from said mold inlet opening is at least equal to the smallest cross sectional dimension of the mold cavity cross sectional profile.

4. The apparatus according to claim 1, wherein said melt passage is defined between a second peripheral edge portion of said plate member and a second interior wall surface portion of said outlet conduit.

* * * * *